US009261010B2

(12) United States Patent
Kuhlbach

(10) Patent No.: US 9,261,010 B2
(45) Date of Patent: Feb. 16, 2016

(54) LIQUID-COOLED INTERNAL COMBUSTION ENGINE WITH A PARTIALLY INTEGRATED EXHAUST MANIFOLD

(71) Applicant: Ford Global Technologies, LLC, Dearborn, MI (US)

(72) Inventor: Kai Sebastian Kuhlbach, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 79 days.

(21) Appl. No.: 13/867,805

(22) Filed: Apr. 22, 2013

(65) Prior Publication Data

US 2013/0291811 A1 Nov. 7, 2013

(30) Foreign Application Priority Data

May 3, 2012 (EP) ..... 12166516

(51) Int. Cl.

| | |
|---|---|
| ***F01N 13/10*** | (2010.01) |
| ***F01P 3/12*** | (2006.01) |
| ***F02F 1/24*** | (2006.01) |
| ***F02F 1/40*** | (2006.01) |

(52) U.S. Cl.

CPC . *F01P 3/12* (2013.01); *F02F 1/243* (2013.01); *F02F 1/40* (2013.01)

(58) Field of Classification Search

CPC ..... F01N 13/10; F01N 13/105; F01N 13/08; F01N 3/046; F02F 1/42; F02F 1/4214; F02F 1/4264; F02F 1/4271; F02F 1/36–1/40

USPC ..... 123/41.79, 193.5

See application file for complete search history.

(56) References Cited

U.S. PATENT DOCUMENTS

| | | | | |
|---|---|---|---|---|
| 3,570,462 | A * | 3/1971 | Hauk | 123/547 |
| 4,993,227 | A * | 2/1991 | Nagura et al. | 60/605.1 |
| 6,378,308 | B1 * | 4/2002 | Pfluger | 60/612 |
| 6,484,499 | B2 * | 11/2002 | Coleman et al. | 60/612 |
| 8,079,214 | B2 * | 12/2011 | Son et al. | 60/323 |
| 2007/0157893 | A1 * | 7/2007 | Wei et al. | 123/41.08 |
| 2008/0308050 | A1 * | 12/2008 | Kuhlbach et al. | 123/41.82 R |
| 2010/0083920 | A1 * | 4/2010 | Kuhlbach | 123/41.82 R |
| 2012/0006287 | A1 * | 1/2012 | Hayman et al. | 123/41.79 |
| 2012/0312002 | A1 | 12/2012 | Kuhlbach et al. | |

FOREIGN PATENT DOCUMENTS

| | | | |
|---|---|---|---|
| DE | 102007057310 | A1 | 6/2009 |
| EP | 2172635 | A1 | 4/2010 |

OTHER PUBLICATIONS

Giacosa, Dante, "Motori Endotermici", Milano: Hoepli, pp. 248-250, 14th Edition, 1986, (partial translation), 3 pages.

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

A liquid-cooled engine and method for its operation is described wherein the engine includes a cylinder head comprising at least one coolant jacket and exhaust manifold at least partially integrated therein. In one particular example, the exhaust pipes merge in stages within the cylinder head before merging into a common exhaust gas collector outside the cylinder head. Inclusion of a coolant system according to the present disclosure allows the thermal load of the cylinder head to be controlled, which thereby allows cooling to be achieved in a targeted manner inside the cylinder head by means of liquid cooling and forced convection.

20 Claims, 4 Drawing Sheets

LIQUID-COOLED INTERNAL COMBUSTION ENGINE WITH A PARTIALLY INTEGRATED EXHAUST MANIFOLD

CROSS REFERENCE TO RELATED APPLICATIONS

The present application claims priority to European Patent Application No. 12166516.0, filed on May 3, 2012, the entire contents of which are hereby incorporated by reference for all purposes.

BACKGROUND AND SUMMARY

Internal combustion engines have a cylinder block and at least one cylinder head connected together at their mounting faces to form the cylinder. The cylinders further have cylinder bores wherein pistons or cylinder linings reside. Within the cylinder bores, mobile pistons reciprocate axially along the guide to form the combustion chambers of the internal combustion engine.

During the charge change, the combustion gasses are expelled via outlet openings of the cylinders and the combustion chambers are re-filled with fresh mixture or charge air via inlet openings. To control the charge change, an internal combustion engine includes control elements and activation devices designed to activate the control elements. For example, in four-stroke engines reciprocating valves are almost exclusively used as control elements to control charge change during operation of the internal combustion engine, and to execute an oscillating stroke movement that opens and closes the inlet and outlet openings. The valve actuating mechanism that moves the valves, including the valves themselves, is commonly referred to as the valve gear. A typical cylinder head is designed to receive the valve gear.

Example cylinder heads known in the art have at least partly integrated inlet channels (e.g. inlet pipes) that lead to inlet openings and outlet channels (e.g. exhaust pipes) that connect to outlet openings of the cylinder head. Therein, when more than one exhaust pipe from the cylinders is present, the number of pipes present may be merged into a combined exhaust pipe, which is generally referred to as an exhaust manifold.

The inventors have recognized disadvantages with the cylinder head and exhaust manifold described above and herein disclose example exhaust pipes of a four cylinder engine that merge in stages such that at least one exhaust pipe from an outermost cylinder and at least one exhaust pipe from an adjacent innermost cylinder merge into a part exhaust pipe, wherein the two part exhaust pipes from the four cylinders formed in this way further merge into a combined exhaust pipe. Therefore, according to the present disclosure, advantages are offered since the total length, and hence the volume, of all exhaust pipes of the exhaust gas discharge system can be substantially reduced.

In one particular example based on exhaust pipes that merge in stages, the exhaust pipes merge into part exhaust pipes inside the cylinder head, which thus forms two part exhaust manifolds. The two part exhaust pipes then merge into a combined exhaust pipe outside the cylinder head so that the exhaust gas discharge system emerges from the cylinder head in the form of two exhaust gas outlet openings. For example, in the internal combustion engine of the present disclosure, the two exhaust gas outlet openings are arranged offset and spaced apart from each other along the longitudinal axis of the cylinder head so that the openings have substantially the same spacing from the mounting face of the cylinder head. This horizontal arrangement of the two outlet openings offers advantages with regard to achieving a low cylinder head height and an increased density of packaging within the engine system. However, it also relies on the two adjacent cylinders forming a group so the exhaust pipes are merged into part exhaust pipes. Furthermore, even if the exhaust pipes were to merge respectively into a part exhaust pipe forming a part exhaust manifold, wherein the outlet openings lie vertically above each other in the vertical direction, or in the direction of a cylinder longitudinal axis, the offset relative to each other may result in different spacings from the mounting face, which presents difficulties with respect to packaging of the engine system.

The present description of the approach to achieve the merging of the exhaust pipes at least partly within the cylinder head may offer several advantages. For example, integration of the part exhaust pipes in the cylinder head leads to a more compact construction of the internal combustion engine and a denser packaging in the engine bay. As such, a weight reduction of the internal combustion engine may be realized that leads to cost benefits during engine production and installation. Furthermore, the integration can have an advantageous effect on the arrangement and operation of an exhaust gas post-treatment system provided downstream in the exhaust gas discharge system. For example, in some embodiments, a reduced travel length of the hot exhaust gasses to various exhaust gas post-treatment systems provides little time for the exhaust gasses to cool before treatment, which may enable an exhaust gas post-treatment system to reach its operating temperature or trigger temperature as quickly as possible, in particular after a cold start of the internal combustion engine. In this context, extensive integration of the exhaust manifold in the cylinder head is advantageous and the aim of the present disclosure is to minimize the thermal inertia of the partial piece of the exhaust pipes between the outlet opening at the cylinder and the exhaust gas post-treatment system, which may be achieved by reducing the mass and length of the partial pieces.

In one particular example, an internal combustion engine charged by an exhaust gas turbocharger, the turbine may be arranged as close as possible to the outlet, for example, the outlet openings from the cylinders. This may be done in order to make optimum use of the exhaust gas enthalpy of the hot exhaust gasses, which in some instances is determined by the exhaust pressure and temperature, to thereby achieve a rapid response behavior of the turbocharger. As described already, when the system is implemented according to the present disclosure, the thermal inertia and volume of the pipe system between the outlet openings of the cylinders and the turbine may be substantially minimized, which results from extensive integration of the exhaust manifold within the cylinder head.

The method described further utilizes the circumstance that modern internal combustion engines are increasingly equipped with liquid cooling systems. When liquid cooling is present within the engine system, the internal combustion engine or cylinder head may, for example, be fitted with at least one coolant jacket, or in another example, coolant channels designed to carry coolant through the cylinder head. Implementation of liquid cooling systems often entails a complex structure of the cylinder head construction. Therefore, integration of the part exhaust pipes within the cylinder head makes it more difficult to arrange or form a sufficiently large coolant jacket volume in cylinder heads under a high thermal and mechanical load. However, because the exhaust manifold is largely integrated into the cylinder head, the manifold may be cooled by targeted cooling provided in the cylinder head and so may not be produced from materials with a high thermal load capacity, which are increasingly cost-intensive.

In particular, charged internal combustion engines are subject to a high thermal load and therefore impose high cooling restrictions. For example, the heat released by the exothermic chemical conversion of fuel combustion is dissipated partly to the cylinder head and cylinder block via the walls delimiting the cylinder chamber, and partly to other components and the environment via the exhaust gas flow. Therefore, to keep the thermal load of the cylinder head within a desired operating range, cooling is achieved in a targeted manner inside the cylinder head by means of liquid cooling and forced convection. The heat may then be dissipated to the coolant in the interior of the cylinder head. The coolant is further delivered by means of a pump arranged in the cooling circuit so it circulates throughout the coolant jacket. As such, the heat dissipated to the coolant is discharged from the interior of the cylinder head and extracted from the coolant in a heat exchanger. In view of the above, the object of the present invention is to provide a liquid-cooled internal combustion engine according to the present disclosure, which is optimized with regard to liquid cooling.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
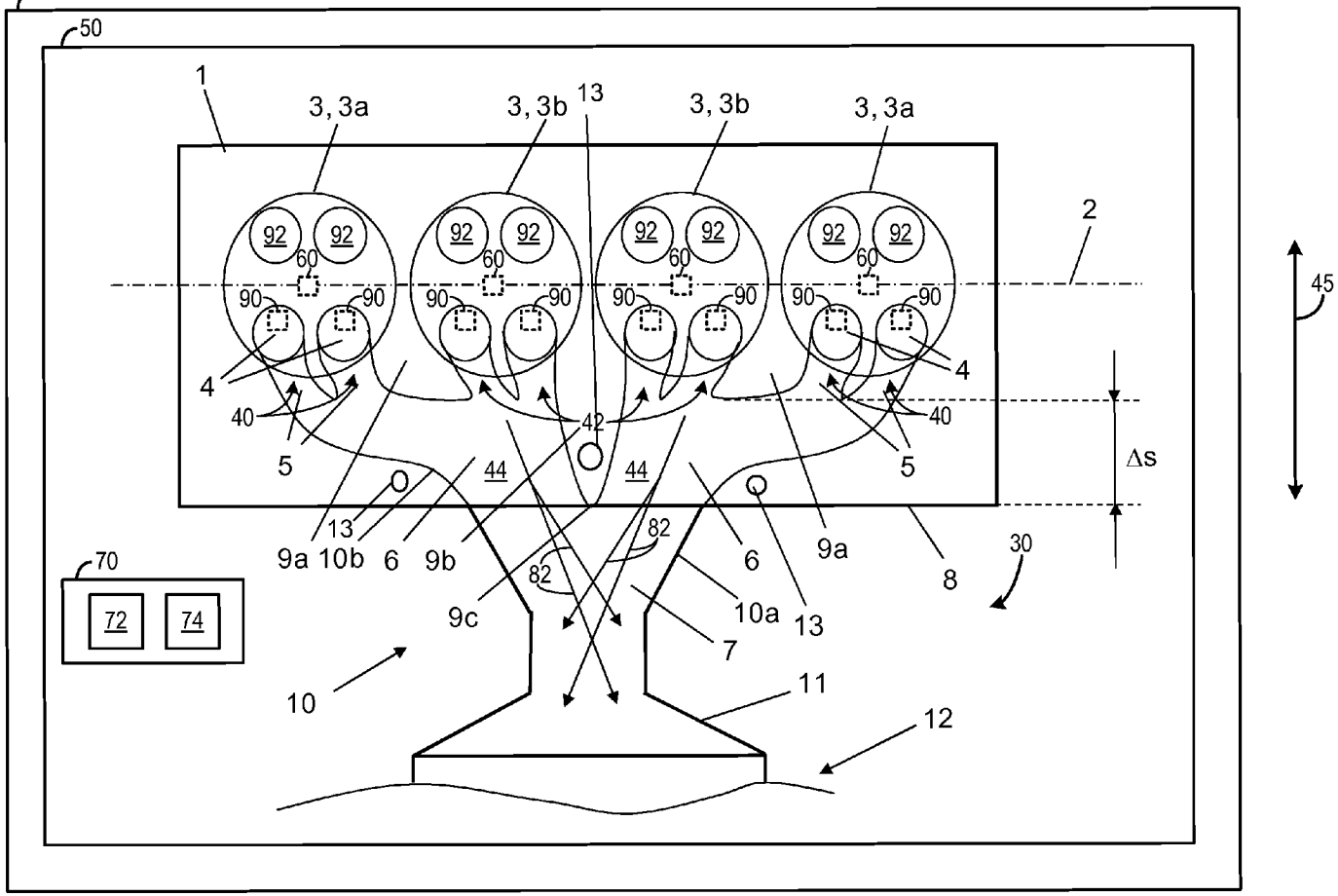
FIG. 1 shows schematically a first embodiment of a cylinder head in cross-section.

FIG. 1 shows schematically one embodiment of cylinder head 1 of an internal combustion engine 50 together with a segment of the inlet housing 11 of a turbine 12. Specifically, a cross-section of a cylinder head 1, a turbine 12, and an inlet 11 of the turbine 12 is illustrated in FIG. 1. Cylinder head 1 has four cylinders 3 which are arranged in line, for example, along the longitudinal axis 2 of cylinder head 1. Cylinder head 1 therefore has two outermost cylinders 3A and two innermost cylinders 3B. The engine 50 may be included in a vehicle 100. Although one cylinder head is depicted it will be appreciated that in other embodiments the engine 50 may include a second cylinder head having a similar configuration to cylinder head 1. Thus, the engine 50 may include a second bank of cylinders in some embodiments.

The cylinder head 1 may be further connected to a cylinder block to form combustion chambers. The cylinder block may include cylinder bores to accommodate pistons and cylinder liners. The pistons may be guided for axial motion in the cylinder liners and cylinder head.

The internal combustion engine 50 may be operated by a process involving four strokes (e.g., an intake stroke, a compression stroke, a power stroke, and an exhaust stroke). Specifically, during an exhaust stroke, the combustion gases may be expelled via the exhaust ports of the at least four cylinders, and the combustion chambers subsequently filled in an intake stroke with a fresh mixture or charge air via the intake ports. In order to control the exhaust and intake process, internal combustion engine 50 may include valves and valve actuating components. Specifically, to control the exhaust and intake process, reciprocating valves may be used as control members in the engine. The valves may be configured to perform an oscillating stroke motion during the operation of the internal combustion engine and in this way open and close the intake and exhaust ports. In one embodiment, the valve actuating mechanism for actuating the valves may be valve gear(s). Furthermore, the valve actuating mechanisms may be positioned in the cylinder head.

In one example, the valve gears may be configured to open and close the intake and exhaust valves at desired intervals. Thus, a variable valve timing may be used. However, in other examples variable valve timing may not be utilized. In some examples, the valve gears may be configured to rapidly open the valves to reduce the throttling losses in the inflowing and outflowing gas streams. Moreover, the valve gears may be configured to actuate the valves to fill the combustion chambers with a fresh air/fuel mixture and remove exhaust gas from the combustion chambers.

Figure 3:
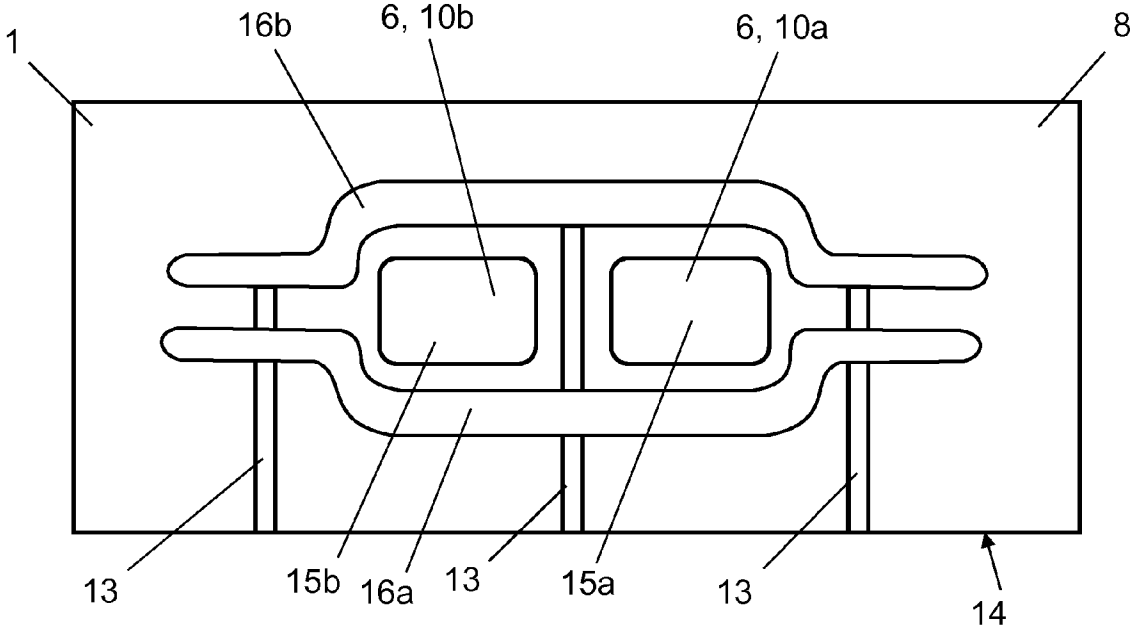
FIG. 3 shows schematically a side view of the embodiment of the cylinder head shown in FIG. 1, partly cut away.

As shown in detail with respect to FIG. 3, cylinder head 1 may have an integrated coolant jacket. The coolant jacket may be sized to meet the cooling requirements of the engine. It will be appreciated that if the engine 50 includes a turbocharger the cooling requirements may be increased. According to the present disclosure, a coolant jacket may be included in a liquid cooling system. It will be appreciated that liquid cooling systems may be able to remove more heat from the engine than air cooling systems. The coolant jacket may include coolant ducts which carry the coolant through the cylinder head and/or cylinder block (not shown). Therefore, heat may be transferred to the coolant (e.g., water with additives) in the cylinder head. The coolant may be delivered to the coolant jacket via a pump arranged in the cooling circuit, and therefore circulate within the coolant jacket. A heat exchanger may also be included in the coolant circuit. The heat exchanger may be configured to transfer the heat removed from the cylinder head to the surrounding environment.

Additionally, cylinder head 1 is shown in the embodiment depicted in FIG. 1 with four cylinders 3. However, cylinder heads having a different number of cylinders may be used in other embodiments. The cylinders 3 are arranged along the longitudinal axis 2 of the cylinder head 1. Thus, the cylinders are arranged in series. Cylinders arranged in such a manner may be referred to as an inline cylinder configuration. Therefore, the cylinder head 1 has two outer cylinders 3*a* and two inner cylinders 3*b*.

Each of the cylinders 3 may include an ignition device for initiating combustion in the cylinder. The ignition devices are indicated via boxes 60 and may not be located in the cross-section shown in FIG. 1. For example, each of the ignition devices may be positioned adjacent to a top of each cylinder. The ignition devices may be spark plugs. However, in other embodiments compression ignition may be used to initiate combustion. The ignition devices may be controlled by a controller 70 including memory 72 executable by a processor 74. Instructions, such as an ignition timing method may be stored in the memory 72. Specifically, the method shown in FIG. 4 may be stored in the memory 72.

Each of the cylinders 3 includes two intake ports 92, in the embodiment depicted in FIG. 1. However, cylinders having another number of ports have been contemplated. Intake valves may be positioned in the intake ports for opening and closing the ports to perform combustion in the cylinders 3, as previously discussed. Intake valve actuating mechanisms (e.g., cams, electronically controlled solenoids, etc.,) may also be included in the engine 50.

Furthermore, each cylinder 3 has two exhaust ports 4, in the depicted embodiment. The exhaust ports 4 enable exhaust gas to be discharged into an exhaust system 30 from the cylinders 3. When two ports are used per cylinder as opposed to one port per cylinder, the time interval for flowing exhaust gas from the cylinders into the exhaust system is reduced, thereby decreasing throttling losses. However, the cylinders may have an alternate number of exhaust ports in other embodiments. It will be appreciated that each of the exhaust ports 4 may have a corresponding exhaust valve, indicated generically via boxes 90, and valve actuating mechanism (e.g., cams, electronically controlled solenoids, etc.,) configured to cyclically open and close during engine operation, to enable combustion. It will be appreciated that a closed valve may inhibit combustion gases from flowing into downstream exhaust lines in the exhaust system. On the other hand, an open valve permits combustion gasses to flow into downstream exhaust lines in the exhaust system.

The exhaust ports 4 are adjoined by exhaust lines 5 included in the exhaust system 30 configured to discharge exhaust gases into the surrounding environment. That is to say, each exhaust port 4 is in fluidic communication with an exhaust line 5 positioned directly downstream of the exhaust port. Directly downstream means that there is no intermediary components positioned between the exhaust port and the exhaust line in the exhaust stream. The exhaust lines 5 of the cylinders 3 come together in stages to form an exhaust gas collector 7. In this way, the exhaust lines 5 are brought together to form a single conduit. Thus, the exhaust gas collector is a common exhaust line and is in fluidic communication with upstream exhaust lines. The two exhaust lines 5 corresponding to outer cylinders 3*a* and the two exhaust lines 5 corresponding to the inner cylinders 3*b* in each case coming together to form a merged exhaust line 6 upstream of the exhaust gas collector 7. Arrows 82 denote the general exhaust gas flow direction in an exhaust manifold 10. Thus, an exhaust line from an outer cylinder and an exhaust line from an inner cylinder fluidly merge at a confluence to form a single merged exhaust line. It will be appreciated that the depicted engine includes two merged exhaust lines. In this way, the exhaust lines 5 from the corresponding pairs of outer and inner cylinders may come together to form a merged exhaust line in a first stage. In a second stage, the merged exhaust lines are then brought together downstream in the exhaust system to form the exhaust gas collector 7. When the exhaust lines are merged in this way, the length of the exhaust lines may be shortened when compared to exhaust manifolds positioned external to the cylinder head. As a result, the compactness of the engine may be increased. Further, it has been found unexpectedly that the cross-talk between the cylinders during engine operation is substantially reduced when the exhaust lines are merged in stages. As a result, combustion operation is enhanced. Thus, the length of the exhaust manifold can be reduced without exacerbating cross-talk between the cylinders.

The exhaust lines 5, merged exhaust lines 6, exhaust gas collector 7, and/or exhaust ports 4 may be included in the exhaust manifold 10. Therefore, the exhaust manifold 10 includes a combination of exhaust lines from multiple cylinders converging in stages and finally converging into a single conduit (e.g., exhaust gas collector 7). When the exhaust lines are merged in this way in the exhaust manifold a significant reduction in the total length of all the exhaust lines and hence in the volume of the manifold may be achieved when compared to exhaust manifolds which may merge all of the exhaust lines into a single collector at once. The exhaust manifold 10 may be at least partially integrated into the cylinder head 1.

The integration or partial integration of the exhaust manifold 10 into the cylinder head 1 increases the compactness of the engine when compared to engines which may position the exhaust manifold exterior to the cylinder head. As a result, the entire drive unit in the engine compartment may be densely packaged. Moreover, the integration of the exhaust manifold into the cylinder head may also reduce the cost of production and assembly as well as reduced the weight of the engine.

Furthermore, integrating or only partially integration the exhaust manifold into the cylinder head may also enhance operation of an exhaust gas after-treatment system provided downstream of the manifold. For example, it may be desirable to reduce the length between the cylinders and exhaust treatment devices (e.g., a catalyst) to reduce temperature losses in the exhaust gas. In this way, the exhaust treatment device may reach a desired operating temperature more quickly during for example a cold start. It will be appreciated that when the distance between the cylinders and an exhaust gas after-treatment device is reduced, the thermal inertia of the exhaust manifold is reduced. Furthermore, the exhaust manifold 10 may emerge from an outer side of the cylinder head 1 and is discussed in greater detail herein. A section 40 of each of the two exhaust lines 5 corresponding to the outer cylinders 3*a* and a section 42 of each of the two exhaust lines 5 corresponding to the inner cylinders 3*b* are in each case separated from one another by an outer separating wall 9*a*, which extends into the exhaust system 30. In this way, the outer separating walls divide exhaust lines corresponding to different cylinders. Thus, the outer separating walls 9*a* are included in the exhaust system 30. The outer separating walls 9*a* each include a first stage confluence at the lateral end of the wall closest to the exterior side-wall 8. The confluence is where the exhaust lines from separate cylinders merge.

Furthermore, sections 44 of the two merged exhaust lines 6 are separated from one another by an inner separating wall 9*b* which extends into the exhaust system 30. Thus, the merged exhaust lines 6 are divided by the inner separating wall 9*b*. It will be appreciated that the exhaust lines associated with the two inner cylinders 3*b* are also separated via the inner separating wall 9*b*. The inner separating wall 9*b* includes an end 9*c*. The end 9*c* is a second stage confluence. The inner separating wall 9*b* is included in the exhaust system 30. Both the inner separating wall 9*b* and the outer separating walls 9*a* are formed integrally with the cylinder head 1. That is to say, that the inner separating wall 9*b* and the outer separating wall 9*a* are included (e.g., integrated into) in the cylinder head 1.

The inner separating wall 9*b* extends a greater distance towards the exterior side-wall 8 than the outer separating walls 9*a*. Thus, the inner separating wall 9*b* has a greater lateral width than each of the outer separating walls 9*a*. A lateral axis 45 is provided for reference. Specifically, the inner separating wall 9*b* extends further in the direction of the exterior side-wall 8 of the cylinder head 1—perpendicularly to the longitudinal axis 2 of the cylinder head 1—than the outer separating walls 9*a* by a distance Δs. Therefore, the difference in the lateral widths of the inner separating wall 9*b* and each of the outer separating walls 9*a* is Δs. In other words, the inner separating wall 9*b* extends beyond the outer separating walls 9*a* by the distance Δs in a lateral direction. As may be greater than or equal to 5 and/or 10 millimeters (mm), in some embodiments.

It has been found unexpectedly that when the inner separating wall 9*b* and the outer separating walls 9*a* are arranged in this way (for example with the particular dimensions mentioned herein) the mutual interference between cylinders is reduced. In other words, the cross-talk caused by waves generated via combustion operation in the cylinders and propagated in the exhaust system between cylinders is substantially reduced. In particular, the interference between the first and second pairs of adjacent inner and outer cylinders may be substantially reduced. As a result, combustion operation may be enhanced, thereby increasing combustion efficiency and therefore the power output of the engine.

Specifically, computer-based simulations have shown that desired torque characteristic may be achieved in an engine having the inner separating wall extending 5 mm or more beyond the outer separating wall in a lateral direction. It will be appreciated that the points on the separating walls which project furthest in a downstream direction into the exhaust system may be used as reference points to measure the difference between the separating walls. In other words, the points laterally closest to the exterior side-wall 8 may be used as reference points. It will be appreciated that as Δs increases the more pronounced is the separation of the two merged exhaust lines from one another in terms of distance and the more clearly noticeable is the effect thereby achieved that the cylinder groups do not interfere with one another, or interfere to a lesser degree with one another, and in particular do not hinder one another during the combustion operation in the engine. It will be appreciated that Δs may be selected based on its interference reduction characteristics as well as a desired cylinder head and engine compactness.

In the embodiment illustrated in FIG. 1, the end 9*c* of the inner separating wall 9*b* extends to the exterior side-wall 8 of the cylinder head 1. The end 9*c* is the point where the gases from the separate exhaust streams converge. In this way, the exhaust streams in the merged exhaust lines 6 are separated from one another by the inner separating wall 9*b* until they leave the cylinder head 1. Thus, the exhaust gasses from the exhaust system flow out of cylinder head 1 via two exhaust outlets.

The exhaust lines 5 corresponding to each of the cylinders 3 and the merged exhaust lines 6 of the cylinder pairs are brought together to form an exhaust gas collector 7 outside the cylinder head 1, therefore at least a portion of the exhaust manifold is integrated into the cylinder head and extends through the exterior side-wall. Thus, the exhaust gas collector 7 is positioned in the exhaust system 30 exterior to the cylinder head 1 in the embodiment depicted in FIG. 1. However, other exhaust gas collector locations have been contemplated, such as at a location inside the cylinder head 1.

The exhaust lines 5, the merged exhaust lines 6, exhaust gas collector 7, the inner separating walls 9*b*, and/or the outer separating walls 9*a* may be included in the exhaust manifold 10. Thus, the exhaust manifold includes a combination of exhaust lines from multiple cylinders converging into a single conduit. The exhaust ports 4 may also be included in the exhaust manifold 10, in some embodiments. The exhaust manifold 10 may be arranged upstream of the turbine 12. Additionally, the exhaust manifold 10 may include the exhaust lines upstream of the turbine in the exhaust system. However, in some embodiments the inlet region of the turbine may be included in the exhaust manifold. A section 10*b* of the exhaust manifold 10 is included in the cylinder head 1 and a second 10*a* of the exhaust manifold is positioned external to the cylinder head.

Figure 2:
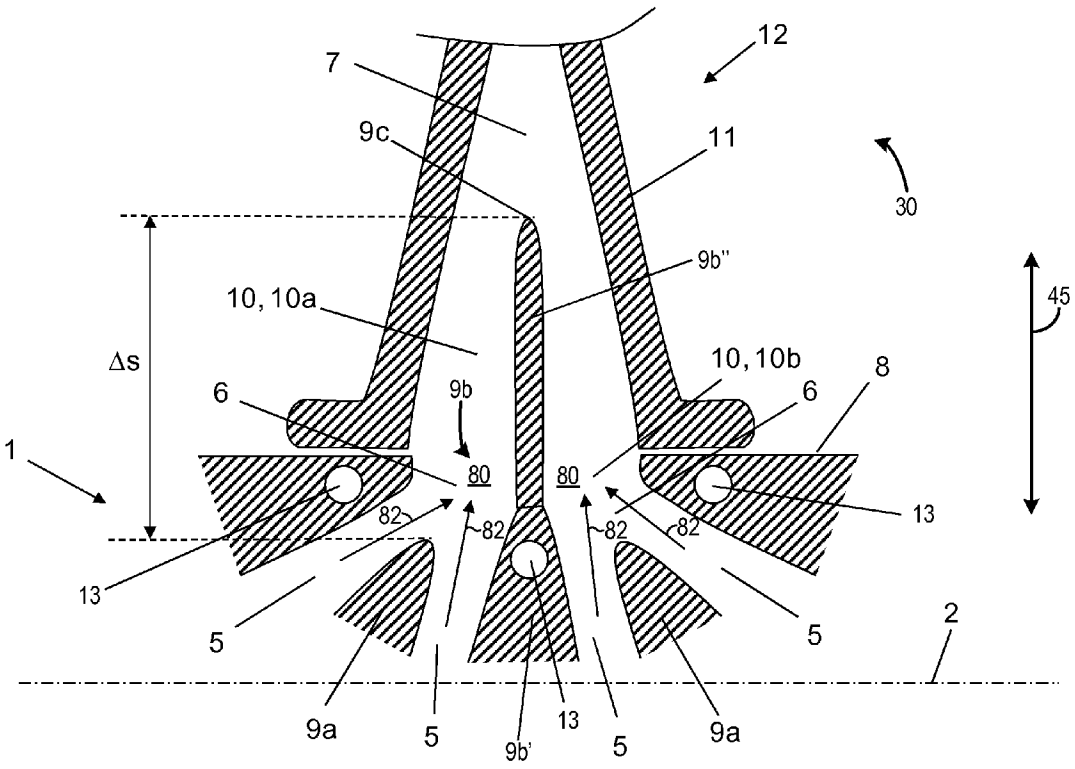
FIG. 2 shows schematically a second embodiment of the cylinder head in cross-section.

In the embodiment depicted in FIG. 2 the exhaust manifold 10 is partially integrated into the cylinder head 1. Again, the exhaust manifold 10 includes the section 10*b* positioned in the cylinder head 1 and the section 10*a* positioned outside of the cylinder head. The section 10*b* may be referred to as an interior manifold section and the section 10*a* may be referred to as an exterior manifold section.

Returning to FIG. 1, as will be described in greater detail with respect to FIG. 3, cylinder head 1 further includes two coolant jackets (not shown) fluidically communicating with a passage therebetween at a merged exhaust line that serve for the passage of coolant throughout the cylinder head. Therefore, three connections 13 are provided. Two connections 13 are arranged on the side of sections 10*a*, 10*b* facing away from the four cylinders 3, namely on opposite sides of the sections 10*a*, 10*b*. An additional connection 13 is provided in the inner separating walls 9*b*, which separates the two sections 10*a*, 10*b* and protrudes into the exhaust gas discharge system. The connections 13 may extend to the mounting face 14 and therefore serve to supply cylinder head 1 with coolant via the cylinder block.

The turbine 12 of an exhaust turbocharger has an inlet 11 in fluidic communication with and integrated into the exhaust gas collector 7. In this way, exhaust gas may flow from the exhaust gas collector to the downstream turbine. Specifically, the inlet 11 is in direct fluidic communication with the exhaust gas collector 7. In other words, there are no components between the exhaust gas collector and the inlet of the turbine in the exhaust system 30. In this way, the distance traveled by the exhaust gas in the exhaust system and the volume of the exhaust manifold is reduced, thereby increasing the system's efficiency. Moreover, the response time of the turbine after a change in engine output is decreased. However, in other embodiments there may be intermediary components between the inlet of the turbine and the exhaust gas collector.

In some examples, the exhaust gas collector 7 merges smoothly into the inlet 11. That is to say that a wall of the exhaust gas collector may be continuous with the inlet of the turbine.

The firing order (e.g., ignition sequence) of the cylinders may be selected to further reduce cross-talk between the cylinders during engine operation. When the internal combustion engine 50 has spark ignition, an ignition sequence of 1-2-4-3 may be used for initiating combustion in the cylinders. It will be appreciated that the numbering of the cylinder in an inline cylinder bank may start with an outer cylinder (e.g., an outer cylinder facing the clutch) and travel sequentially down the cylinder bank in a longitudinal direction. Exemplary numbering of the cylinders in an internal combustion engine is shown in DIN 73021. Specifically in some examples, the cylinders may be ignited at intervals spaced by approximately 180° of crank angle. Therefore in some examples, starting from the first cylinder, the ignition times, measured in degrees of crank angle, may be as follows: 0-180-360-540. In contrast to other cylinder firing patterns, the cylinders in the cylinder group are fired immediately in succession in the aforementioned case, and these cylinders thus have a thermodynamic offset of 180° of crank angle.

When the cylinders are fired in the aforementioned pattern the cross-talk between the cylinders may be further reduced. However, in other embodiments other suitable ignition sequences may be used, such as an ignition sequence of 1-3-4-2.

FIG. 2 shows a second embodiment of the cylinder head 1 together with a section of the inlet 11 of a turbine 12. It will be appreciated that a cross-sectional view of the cylinder head 1 is shown in FIG. 2. The differences with respect to the embodiment illustrated in FIG. 1 are discussed, for which reason reference will be made in other respects to FIG. 1. Identical reference numerals have been used for similar components.

In contrast to the embodiment shown in FIG. 1, the inner separating wall 9*b* in the embodiment illustrated in FIG. 2 extends beyond the exterior side-wall 8 of the cylinder head 1 and into the inlet 11 of the turbine 12.

The inner separating wall 9*b* may have a modular construction. That is to say, that the inner separating wall 9*b* includes a plurality of sections which may be separately manufactured and subsequently coupled to one another. However, in other embodiments, the inner separating wall 9*b* may not be separately manufactured. As shown in FIG. 2, the inner separating wall 9*b* may include a first section 9*b*' and a second section 9*b*" extending into the inlet 11 of the turbine 12. However, the second section 9*b*" may be integrated into another suitable component in the exhaust system, such as an exhaust conduit. Additionally, the turbine 12 may include a rotor assembly (not shown) and may be rotationally coupled to a compressor positioned in an intake system of the engine and configured to increase the intake air pressure. Thus, the turbine 12 may be included in a turbocharger. It will be appreciated that the turbine 12 is in fluidic communication with each of the cylinders 3 shown in FIG. 1. It will be appreciated that a turbocharger has several benefits over mechanical driven chargers (e.g., supercharger). For example, a supercharger requires energy generated from the engine to operate. For example, the supercharger may be driven via the crankshaft or via electricity generated in the engine. In contrast, the turbocharger uses exhaust gas energy to operate.

In the turbocharger, the energy transferred to the turbine from the exhaust stream may be used to drive a compressor, which transports and compresses the charge air fed to it, and pressure charging of the cylinders is thereby achieved. A charge air cooler configured to remove heat from the intake air downstream of the compressor may also be used in the engine. Pressure charging via the turbocharger may boost the power of the internal combustion engine. However, pressure charging may also decrease fuel consumption in the engine while producing a desired amount of power.

In some examples, the turbine may include a wastegate for directing exhaust gas around the turbine to provide desired torque characteristics in the engine. The wastegate may be configured to direct exhaust gas around the turbine when the exhaust gas flow exceeds a predetermined value. Further in other embodiments, a plurality of turbochargers may be included in the engine which may be arranged in series or parallel.

The turbine can furthermore be provided with variable turbine geometry, which allows a larger degree of adaptation to the respective operating point of the internal combustion engine through adjustment of the turbine geometry or of the effective turbine cross section. In this case, adjustable guide vanes for influencing the direction of flow may be arranged in the inlet region of the turbine. If the turbine has a fixed geometry the guide vanes may be arranged in a stationary manner but also may be arranged in an immovable manner (e.g., rigidly fixed) in the turbine inlet. In the case of variable geometry, in contrast, the guide vanes may be arranged in a stationary manner but are not completely immovable, being pivotable about their axis to enable the inlet flow to the guide vanes to be influenced.

Continuing with FIG. 2, it will be appreciated that the second section 9*b*" may be included in an external manifold section. Furthermore, in the depicted embodiment exhaust gas flows from the cylinder head 1 in the form of two outlets 80. Arrows 82 depict the general flow of exhaust gas through the exhaust manifold 10. It will be appreciated that the outlets 80 are fluidly separated. That is to say the exhaust gas cannot flow therebetween. The two exhaust streams continue to be separated by the inner separating wall section 9*b*", even after it leaves the cylinder head 1. In the present case, the exhaust gas collector 7 is integrated into the inlet of the turbine 12. Thus, the exhaust gas collector 7 is positioned outside the cylinder head 1. In this way, the distance traveled by the exhaust gas between the cylinders and the turbine is reduced thereby increasing the efficiency of the exhaust system. As a result, the speed of the turbine may be increased during engine operation, thereby increasing the power output of the engine.

The end 9*c* of the second section 9*b*", which extends into the inlet 11, is positioned at a distance from the exterior side-wall 8 of the cylinder head 1, for which reason the section 9*b*" formed by the inlet 11 projects into the cylinder head 1 to enable the first section 9*b*' to be continued. It will be appreciated that the second section 9*b*" may extend a predetermined distance outside of the cylinder head 1 to achieve desired torque characteristic in the engine.

As described above with respect to FIG. 1, and as described in more detail below with respect to FIG. 3, three connections 13 are provided to pass coolant throughout the cylinder head. Two connections 13 are arranged on the side of sections 10*a*, 10*b* facing away from the four cylinders 3, namely on opposite sides of the sections 10*a*, 10*b*. An additional connection 13 is provided in the inner separating walls 9*b*', which separates the two sections 10*a*, 10*b* and protrudes into the exhaust gas discharge system.

FIG. 3 shows a side view, partly cut of the embodiment of cylinder head 1 shown in FIG. 1. Therefore, it will be explained as an addition to FIG. 1, to which reference is otherwise made. For the same components, the same reference numerals are used.

The liquid cooling system within cylinder head 1 comprises two integrated coolant jackets, wherein a lower coolant jacket 16*a* is arranged between exhaust pipes 5, 6 and mounting face 14 of cylinder head 1, and upper coolant jacket 16*b* is arranged on the side of the exhaust pipes 5, 6 opposite the lower coolant jacket 16*a*, are provided.

Between the lower coolant jacket 16*a* and the upper coolant jacket 16*b* three connections 13 are provided that serve to pass coolant. The connections 13 extend to the mounting face 14 and also serve to supply cylinder head 1 with coolant via the cylinder block (not shown). Two connections 13 are arranged on opposite sides of the integrated part exhaust manifolds 10*a* and 10*b*. An additional connection 13 is provided in the inner wall segment 9*b* that separates the two part exhaust manifolds 10*a* and 10*b* and protrudes into the exhaust gas discharge system as described above with respect to FIG. 1.

In FIG. 3, it is evident that the two part exhaust manifolds 10*a* and 10*b* exit the exterior side-wall 8 outside of cylinder head 1 in exactly two horizontally arranged exhaust gas outlet openings 15*a* and 15*b* divided by a wall, the passages further converging outside the cylinder head to complete the manifold. The two exhaust gas outlet openings 15*a* and 15*b* are offset from one another and spaced apart along a longitudinal axis of cylinder head 1. Furthermore, as shown, the openings 15*a* and 15*b* have substantially the same spacing relative to the mounting face 14 of cylinder head 1.

With respect to the cooling of internal combustion engine 50 according to the present disclosure that has a lower coolant jacket 16*a* and an upper coolant jacket 16*b* opposite the lower coolant jacket, at least one connection is provided in the cylinder head through which coolant may flow from the lower coolant jacket 16*a* to the upper coolant jacket 16*b* and/or vice versa. The connection in the present case is an opening or flow channel that connects lower coolant jacket 16*a* to upper coolant jacket 16*b* and thereby allows coolant to be exchanged between the two coolant jackets. In principle, this allows cooling in the region of a connection. Furthermore, the conventional longitudinal flow of the coolant, e.g. the coolant flow in the direction of the longitudinal axis of the cylinder head, is supplemented by a transverse coolant flow which runs transverse to the longitudinal flow and approximately in the direction of a longitudinal axis of a cylinder. Herein, the coolant flow carried by connections 13 may substantially contribute to heat dissipation within the engine. Thereby, the cooling of the cylinder head may additionally and advantageously be enhanced since a pressure drop is created between the upper and lower coolant jackets. In addition, since the fluid speed in the at least one connection may increase, an increased heat transfer due to convection may also result.

According to the present disclosure, the connections 13 may be arranged in close proximity and adjacent to a merged exhaust line 6, preferably in the region of the exhaust gas outlet opening of the merged exhaust line from the cylinder head. Thus, for several reasons, connection 13 may be located in a region wherein the hot exhaust gasses from the cylinders of the internal combustion engine are collected, that is, in a region in which the cylinder head is under a particularly high thermal load.

First, in contrast to an individual exhaust pipe exposed merely to the exhaust gas or part of the exhaust gas of one cylinder that connects to an outlet opening of a cylinder, the exhaust gasses from two cylinders pass through the merged exhaust line. In other words the mass quantity of exhaust gas which emits or may emit heat to the cylinder head is greater.

Second, a merged exhaust line is exposed to hot exhaust gasses for a longer time, whereas the exhaust pipes of individual cylinders are exposed to hot exhaust gasses flowing through them during the charge change of an individual cylinder. In addition, when the inflow region of the merged exhaust line is taken into account, the exhaust gas flows from the individual exhaust pipes may be deflected to a greater or lesser degree in order to accommodate the merging of the exhaust pipes. Therefore, individual exhaust gas flows in this region may have, at least partially, a speed component perpendicular to the walls of the exhaust gas discharge system, which may increase the heat transfer from convection and consequently the thermal load of cylinder head 1.

For these reasons it is therefore advantageous to arrange at least one connection 13 adjacent to, or in close proximity to a merged exhaust line.

The cylinder head 1 of internal combustion engine 50 according to the present disclosure is particularly suitable for charged engines that may benefit from efficient and optimized cooling because of higher exhaust gas temperatures. Therefore, embodiments of internal combustion engine 50 with two cylinder heads also fall within the description of the present disclosure. For example, an internal combustion engine may have two cylinder heads, wherein the cylinders are divided into two cylinder banks. As such, the merging of the exhaust pipes of the two cylinder heads may take place in a manner consistent with the above description so that the method based on a liquid-cooled internal combustion engine may be provided that is optimized with respect to liquid cooling.

In another embodiment, the liquid-cooled internal combustion engine may have at least one connection 13 that is substantially fully integrated in the cylinder head. This embodiment is, however, delimited for example from designs of the cylinder head in which an opening is provided in the outer wall or outside the cylinder head. Therefore, the opening serves for the supply or extraction of coolant into or from the upper and/or lower coolant jacket. As such, an opening may not constitute a connection in the sense of the present disclosure.

Herein, at least one connection as part of the production of the head can be fully open towards the outside temporarily via an access opening, for example, for the removal of a sand core. The final finished cylinder head, however, according to the embodiment described herein has at least one connection 13 substantially fully integrated in the outer wall, for which any proposed access to the connection is closed. In principle, embodiments can also be produced in which a coolant supply or coolant extraction takes place in the region of at least one connection, for which a channel branches from the at least one connection and emerges at the outer wall.

In still other embodiments, the liquid-cooled internal combustion engine has advantages in which a distance $\Delta$ between at least one connection 13 and the merged exhaust pipe is less than a half diameter D of a cylinder, or $\Delta \leq 0.5D$. However, this is not limiting and in another embodiment, the distance may be less than one quarter of the diameter D of a cylinder, or $\Delta \leq 0.25D$, wherein the distance results from the spacing between the outer wall of the merged exhaust pipe and the outer wall of the connection 13. Therefore, the shorter the distance, the greater the cooling effect achieved by the connection 13, and the greater the heat dissipation.

In yet further embodiments, the liquid-cooled internal combustion engine may include at least one connection 13 arranged on the side of the integrated part exhaust manifold facing away from the four cylinders. This has advantages with regard to thermal balance and construction. Therefore, to a certain extent at least one connection lies outside the integrated exhaust manifold and hence in a region in which the space available is greater than, for example, inside the manifold (e.g. on the side facing the cylinders).

Embodiments of the liquid-cooled internal combustion engine are advantageous in which at least two connections are provided that are arranged on opposite sides of the manifold systems. A symmetrical arrangement of at least two connections in the region of the part exhaust manifolds or part exhaust pipes takes into account the circumstance that the system of exhaust pipes integrated in the cylinder head is usually formed symmetrically. Therefore, a matching formation of the exhaust gas discharge system and the cooling thus ensures a symmetrical temperature distribution in the cylinder head.

Embodiments of the liquid-cooled internal combustion engine are advantageous in which at least one additional connection is provided in the inner wall segment which separates the two part exhaust manifolds and protrudes into the exhaust gas discharge system as described above with respect to FIG. 1. As was described therein, the exhaust pipes of the four cylinders of the at least one cylinder head of the internal combustion engine according to the present disclosure merge in stages, wherein in each case an outermost cylinder and the adjacent innermost cylinder form a cylinder pair, and the exhaust pipes merge inside the cylinder head into a merged exhaust pipe, wherein the merged exhaust pipes further emerge from the cylinder head separately from each other. This is achieved by a constructional, or objective feature of the internal combustion engine, namely that the outer wall segments each separate the exhaust pipes of a cylinder pair, which extends in the direction of the outside of the cylinder head perpendicular to the longitudinal axis of the cylinder head for less distance than the inner wall segment that separates the two merged exhaust pipes of the two cylinder pairs inside the cylinder head. The inner wall segment, in particular the end 9*c* of this segment, is under a higher thermal load as this segment protrudes into the exhaust gas discharge system, since it delimits both part exhaust manifolds and hence is exposed to hot exhaust gasses in the manifold from both sides. To this extent it is advantageous for the purpose of cooling this segment to provide at least one connection or at least one additional connection in the inner wall segment.

Embodiments of the liquid-cooled internal combustion engine are advantageous in which at least one exhaust gas turbocharger is provided, wherein the turbine of the at least one exhaust gas turbocharger is arranged in the combined exhaust pipe and has an inlet region for supplying the exhaust gasses. The exhaust gas of the four cylinders is thus fed to a turbine, wherein the at least one turbine is arranged preferably close to the engine in order to be able to make optimum use of the exhaust enthalpy of the hot exhaust gasses.

The advantages of an exhaust gas turbocharger in comparison with a mechanical charger, for example, are that no mechanical connection is required to transmit the power between the charger and the internal combustion engine. For example, whereas a mechanical charger draws the energy for its operation completely from the internal combustion engine, the exhaust gas turbocharger uses the exhaust energy of the hot exhaust gasses. Therefore, the energy emitted by the exhaust gas flow at the turbine is used to drive a compressor which delivers and compresses the charge air supplied to it, and thus charges the cylinders. Where applicable, charge air cooling may be provided in which the compressed combustion air is cooled before it enters the cylinders. In some instances, charging serves to increase the power of the internal combustion engine. Charging is, however, also a suitable means for shifting the load collective, for the same vehicle peripheral conditions, towards higher loads at which the specific fuel consumption is lower.

Often when the engine rotation speed falls below a threshold level, a torque drop may be observed. Therefore, attempts are made to enhance the torque characteristic of the charged internal combustion engine through various measures, for example, through a small design of turbine cross section and exhaust gas blow-off. Such a turbine is also referred to as a wastegate turbine. Therefore, if the exhaust gas mass flow exceeds a threshold size, by opening a shut-off element, part of the exhaust gas flow may be guided over the turbine or turbine impeller by means of a bypass line as part of so-called exhaust gas blow-off. In another embodiment, the torque characteristics of a charged internal combustion engine may further be enhanced by including several turbochargers arranged in parallel or in series, for example, by several turbines arranged in parallel or in series. Therefore, embodiments of liquid-cooled internal combustion engines are advantageous in which at least two exhaust gas turbochargers are provided, wherein a turbine of an exhaust gas turbocharger is arranged in each of the two part exhaust pipes.

Embodiments of the liquid-cooled internal combustion engine are advantageous in which at least one exhaust gas turbocharger is provided, wherein the turbine of the at least one exhaust gas turbocharger is a double-flow turbine comprising two inlet channels arranged in an inlet region, wherein each inlet channel is connected with a merged exhaust pipe for supplying the exhaust gasses. In such embodiments, the merged exhaust pipes can be merged into an exhaust gas collector in the turbine or downstream of the turbine. Furthermore, in principle, the turbine can be equipped with a variable turbine geometry that allows extensive adaptation to the respective operating point of the internal combustion engine by adjustment of the turbine geometry or effective turbine cross section. Herein, adjustable guide vanes are arranged in the inlet region of the turbine to influence the flow direction. However, in contrast to the moving vanes of the rotating impeller, the guide vanes do not rotate with the turbine shaft. Conversely, if the turbine has a substantially fixed and unchanging geometry, the guide vanes may be arranged not only stationary but also substantially completely immobile in the inlet region (e.g. substantially rigidly fixed). With a variable geometry, however, the guide vanes are indeed arranged stationary but are not substantially completely immobile. Rather they can rotate about their axes so as to influence the inflow to the moving vanes.

Embodiments of the liquid-cooled internal combustion engine are advantageous in which the smallest diameter $\phi$ of the at least one connection 13 is less than the diameter d of an outlet opening of a cylinder with $\phi \leq d$. The diameter $\phi$ of the at least one connection 13 affects the flow speed through a connection, wherein by reducing the diameter, the flow speed can be raised, which increases the heat transmission by convection. A reduction in diameter also has advantages with regard to the mechanical strength of the cylinder head. For these reasons, therefore, embodiments of the liquid-cooled internal combustion engine are advantageous in which the smallest diameter $\phi$ of the at least one connection 13 is less than half the diameter d of an outlet opening of a cylinder with $\phi \leq 0.5d$. In other embodiments, the liquid-cooled internal combustion engine may offer advantages in which the smallest diameter $\phi$ of the at least one connection 13 is less than one third of the diameter d of an outlet opening of a cylinder with $\phi \leq 0.33d$.

The second part object on which the present disclosure is based, namely indicating a method to operate an internal combustion engine according to description above, is achieved by a method which is characterized in that in the cylinders, combustion is initiated in the sequence 1 -2-4-3, wherein the cylinders are counted and numbered starting with an outermost cylinder in line along the longitudinal axis of the at least one cylinder head.

In the example described above, the exhaust pipes of the four cylinders of the at least one cylinder head of the internal combustion engine merge inside the cylinder head into merged exhaust pipes. In principle there is a risk that the cylinders will exert a mutual influence on charge change, wherein the partial integration of the manifold in the cylinder head boosts this effect. However, this can be countered by a suitable measure, namely by selecting an ignition sequence that deviates from the conventional sequence.

Therefore, according to the method of the present disclosure, the cylinders of the internal combustion chamber are fired in the sequence 1-2 -4-3, instead of the conventional ignition pattern of 1-3-4-2. Starting from the first cylinder the ignition timing points in ° CA are as follows: 0-180-360-540. The numbering of the cylinders of an internal combustion engine is regulated in DIN 73021. For in-line engines, the cylinders are counted in line, starting with the outermost cylinder.

Although, as is the case in conventional ignition sequences, an outermost cylinder and the adjacent innermost cylinder are ignited in direct succession so that these cylinders have a thermodynamic offset of 180° CA, the ignition sequence according to the present disclosure has a more advantageous sequence. The reasons are described in more detail below in the example of the cylinder pair comprising the first and second cylinders.

According to a conventional ignition sequence, the second cylinder is ignited before the first so that the at least one outlet opening of the second cylinder is at the end of its closing process when the first cylinder opens, e.g. clears, it's at least one outlet opening to initiate the charge change. Due to the pressure wave emitted from the first cylinder, exhaust gas already discharged from the second cylinder can be drawn back in to the second cylinder. Where applicable exhaust gas emerging from the first cylinder can also enter the previously ignited second cylinder before its outlet valves close.

If, according to the ignition sequence of the present disclosure, combustion is initiated in the first cylinder before the second cylinder, the above problem can be substantially eliminated with otherwise unchanged peripheral conditions, that is, the same valve opening times, in particular opening durations, and on use of the same manifold and in principle also with the same exhaust gas travel lengths in the exhaust gas discharge system.

The fact that simply changing the ignition sequence of the two adjacent cylinders leads to this result is due to the different lengths of the exhaust pipes from the outlet opening of the respective cylinder to the partial merging point of the cylinder pair at which the exhaust pipes of the cylinder pair combine into a merged exhaust pipe. Because of the different lengths of the exhaust pipes, in the exhaust gas discharge system fresh air introduced during a flushing process forms a longer fresh air column in the exhaust pipe of the first cylinder than in the exhaust pipe of the second cylinder.

If, for example, the second cylinder is ignited before the first, the pressure wave emitted from the first cylinder may overcome or push back into the second cylinder a comparatively short fresh air column before the same pressure wave introduces into the second cylinder exhaust gas which has already been discharged from the second cylinder or has emerged from the first cylinder.

If, however, the first cylinder is ignited before the second cylinder, the pressure wave emitted from the second cylinder may overcome or push back into the first cylinder a longer fresh air column before the same pressure wave introduces into the first cylinder exhaust gas which has already been discharged from the first cylinder or has emerged from the second cylinder.

The method according to the present disclosure is a method for operating a compact internal combustion engine with short exhaust pipes, with which the problem of mutually influencing of the cylinders on charge change can be substantially eliminated. Therefore, embodiments of the method are advantageous in which each cylinder is equipped with an ignition device to initiate external ignition, and wherein the cylinders are ignited in the sequence 1-2-4-3, wherein the cylinders are counted and numbered starting with an outermost cylinder in line along the longitudinal axis of the at least one cylinder head.

The method variant above concerns the use of the method in an internal combustion engine with external ignition, for example, a direct injection petrol engine, the cylinders of which are each equipped with an ignition device to initiate external ignition.

However, embodiments of the method are also advantageous in which the cylinders are operated with auto-ignition, and wherein the auto-ignition of the cylinders is initiated in the sequence 1-2-4-3 , wherein the cylinders are counted and numbered starting with an outermost cylinder in line along the longitudinal axis of the at least one cylinder head.

The above method variant relates to methods in which the combustion is initiated by auto-ignition, and hence also to working methods as normally used in diesel engines. There is also the possibility of using a hybrid combustion process with auto-ignition to operate a petrol engine, for example the so-called HCCI method (homogenous charge compression ignition) which is also known as spatial ignition or CAI (controlled auto-ignition). This method is based on a controlled auto-ignition of the fuel supplied to the cylinder. The fuel, as in a diesel engine, is herein supplied with surplus air (e.g. super-stoichiometric). The lean-burn petrol engine, because of the low combustion temperatures, has comparatively low nitrous oxide emissions NOx and, also as a result of the lean mixture, substantially no soot emissions. In addition the HCCI method leads to a high thermal efficiency. The fuel can be introduced both directly into the cylinder and into the intake manifold, wherein direct injection also allows the dethrottling of the internal combustion engine by elimination of the throttle valve.

Figure 4:
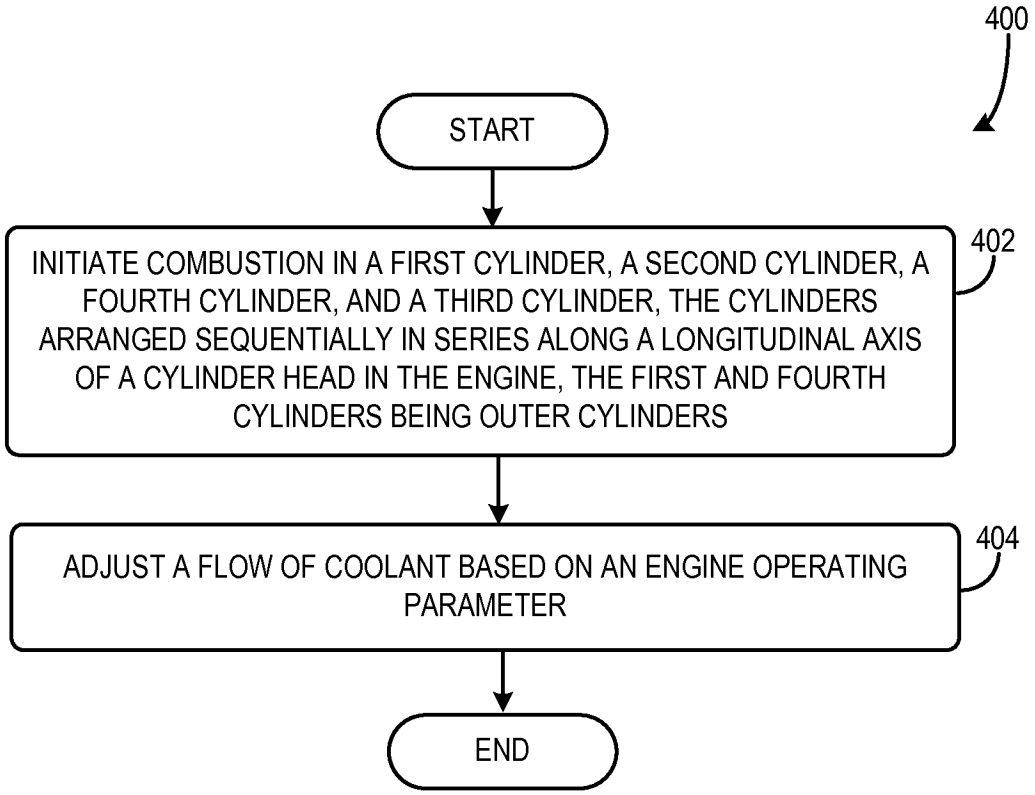
FIG. 4 shows a method for operation of an internal combustion engine.

FIG. 4 shows a method 400 for operation of an internal combustion engine. It will be appreciated that method 400 may be implemented by the engine described above with regard to FIGS. 1-3 or may be implemented by another suitable engine.

At 402 the method includes initiating combustion in a first cylinder, a second cylinder, a fourth cylinder, and a third cylinder, the cylinders arranged sequentially in series along a longitudinal axis of a cylinder head in the engine, the first and fourth cylinders being outer cylinders.

At 404, method 400 further includes adjusting a flow of coolant within cylinder head 1 based on an engine operating parameter. For example, in one embodiment, controller 70 may be programmed with instructions to adjust a flow of coolant by actuating a coolant pump within the coolant system based on an engine load, for instance as determined by a throttle or pedal position. As such, either more or less heat may be dissipated to the coolant from the interior of the cylinder head, which thereby enables the engine system with regard to liquid cooling to be optimized. For example, although not shown, controller 70 may receive various signals from sensors coupled to internal combustion engine 50, including but not limited to: an engine coolant temperature (ECT) from a temperature sensor coupled to a cooling sleeve; a position sensor coupled to an accelerator pedal for sensing force applied by a foot; a measurement of engine manifold pressure (MAP) from a pressure sensor coupled to an intake manifold; an engine position sensor from a Hall effect sensor that senses crankshaft position; a measurement of air mass entering the engine; and a measurement of throttle position from throttle position sensor.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A liquid-cooled engine comprising:

a cylinder head including four cylinders arranged in series along a longitudinal axis of the cylinder head and an exterior side-wall;

an exhaust gas discharge system including, for each cylinder, an exhaust port in fluidic communication with the cylinder and an exhaust line, each of the exhaust lines merging in stages forming an exhaust manifold, the exhaust lines associated with a first outer cylinder and a first inner cylinder fluidly converging to form a first merged exhaust line within the cylinder head and the exhaust lines associated with a second inner cylinder and a second outer cylinder fluidly converging to form a second merged exhaust line within the cylinder head, the first and second merged exhaust lines exiting the cylinder head via two exhaust outlets and fluidly converging downstream to form an exhaust gas collector outside the cylinder head, at least a portion of the exhaust manifold is integrated into the cylinder head and extends through the exterior side-wall, the exhaust manifold including an outer separating wall fluidly dividing the exhaust line corresponding to the first inner cylinder from the exhaust line corresponding to the first outer cylinder and an inner separating wall fluidly dividing the exhaust line associated with the first inner cylinder from the exhaust line associated with the second inner cylinder, the inner separating wall extending beyond the exterior side-wall of the cylinder head and having a greater lateral width than the outer separating wall, and a lateral axis perpendicular to the longitudinal axis of the cylinder head; and a coolant jacket including a lower coolant jacket arranged between the exhaust lines and the exterior side-wall of the cylinder head, and an upper coolant jacket arranged on a side of the exhaust lines opposite the lower coolant jacket, wherein at least one connection is provided between the lower coolant jacket and the upper coolant jacket that serves for passing coolant, and wherein the at least one connection is arranged in close proximity to a merged exhaust pipe.

2. The liquid-cooled engine of claim 1, wherein the at least one connection is substantially fully integrated in the cylinder head.

3. The liquid-cooled engine of claim 2, wherein the at least one connection is arranged laterally on a side of the integrated merged exhaust manifolds away from the four cylinders.

4. The liquid-cooled engine of claim 3, wherein the at least one connection includes at least two connections that are arranged laterally on a side of the integrated merged exhaust manifolds away from the four cylinders, the at least two connections being located on opposite sides of the two merged exhaust manifolds.

5. The liquid-cooled engine of claim 4, wherein at least one additional connection is provided in the inner separating wall that separates the exhaust manifold into two parts in the cylinder head and protrudes into the exhaust gas discharge system.

6. The liquid-cooled engine of claim 5, wherein at least one of the connections extends to the exterior side-wall and serves to supply the cylinder head with coolant via a cylinder block.

7. The liquid-cooled engine of claim 6, wherein a distance between the at least one connection and the merged exhaust line is less than half of a diameter of a cylinder.

8. The liquid-cooled engine of claim 7, wherein each cylinder has at least two outlet openings to discharge exhaust gasses from the cylinder.

9. The liquid-cooled engine of claim 8, wherein at least two exhaust gas turbochargers are provided, and wherein a turbine of the at least two exhaust gas turbochargers is arranged in each of the two parts of the exhaust manifold provided by the inner separating wall that separates the exhaust manifold into two parts.

10. The liquid-cooled engine of claim 8, wherein at least one exhaust gas turbocharger is provided, wherein a turbine of the at least one exhaust gas turbocharger is arranged in a combined exhaust pipe and has an inlet region for supplying exhaust gasses.

11. The liquid-cooled engine of claim 10, wherein at least one exhaust gas turbocharger is provided, wherein the turbine of the at least one exhaust gas turbocharger is a double-flow turbine comprising two inlet channels arranged in an inlet region, wherein each inlet channel is connected with a merged exhaust line for supplying the exhaust gasses.

12. The liquid-cooled engine of claim 11, wherein a smallest diameter of the at least one connection is less than one of:

a diameter of an outlet opening of the at least two outlet openings included within each cylinder, a half diameter of an outlet opening of the at least two outlet openings included within each cylinder, and one third of the diameter of an outlet opening of the at least two outlet openings included within each cylinder.

13. The liquid-cooled engine of claim 12, wherein operating the liquid-cooled engine includes initiating combustion in the sequence 1 - 2 - 4 - 3, wherein the cylinders are counted and numbered starting with an outermost cylinder in line along the longitudinal axis of the at least one cylinder head.

14. The liquid-cooled engine of claim 13, wherein a flow of coolant is adjusted based on an engine operating parameter.

15. A method for operating a liquid-cooled engine, comprising:

initiating combustion in the sequence 1 - 2 - 4 - 3 within a cylinder head that includes four cylinders arranged in series along a longitudinal axis of the cylinder head and an exterior side-wall, and wherein the cylinders are counted and numbered starting with an outermost cylinder in line along the longitudinal axis of the at least one cylinder head, the liquid-cooled engine further including:

an exhaust gas discharge system including, for each cylinder, an exhaust port in fluidic communication with the cylinder and an exhaust line, wherein each of the exhaust lines merge in stages to form an exhaust manifold, the exhaust lines associated with a first outer cylinder and a first inner cylinder fluidly converging to form a first merged exhaust line within the cylinder head and the exhaust lines associated with a second inner cylinder and a second outer cylinder fluidly converging to form a second merged exhaust line within the cylinder head, the first and second merged exhaust lines exiting the cylinder head via two exhaust outlets and fluidly converging downstream to form an exhaust gas collector outside the cylinder head, at least a portion of the exhaust manifold is integrated into the cylinder head and extends through the exterior side-wall, the exhaust manifold including an outer separating wall fluidly dividing the exhaust line corresponding to the first inner cylinder from the exhaust line corresponding to the first outer cylinder and an inner separating wall fluidly dividing the exhaust line associated with the first inner cylinder from the exhaust line associated with the second inner cylinder, the inner separating wall extending beyond the exterior side-wall of the cylinder head and having a greater lateral width than the outer separating wall, and a lateral axis perpendicular to the longitudinal axis of the cylinder head; and a coolant jacket including a lower coolant jacket arranged between the exhaust lines and the exterior side-wall of the cylinder head, and an upper coolant jacket arranged on a side of the exhaust lines opposite the lower coolant jacket, wherein at least one connection is provided between the lower coolant jacket and the upper coolant jacket that serves for passing coolant, and wherein the at least one connection is arranged in close proximity to a merged exhaust pipe.

16. The method of claim 15, wherein each cylinder is equipped with an ignition device to initiate one of external ignition and auto-ignition.

17. The method of claim 16, wherein a flow of coolant is adjusted based on an engine operating parameter.

18. A system, comprising:

an exhaust manifold only partially integrated into a cylinder head with exhaust lines coupled to cylinders therein forming separate passages merged into first and second merged exhaust lines within the cylinder head, the first and second merged exhaust lines exiting an exterior side-wall in exactly two horizontally arranged openings divided by a wall, the first and second merged exhaust lines further converging outside the cylinder head to complete the manifold, an inner separating wall formed integrally with the cylinder head fluidly dividing the first and second merged exhaust lines and extending beyond the exterior side-wall of the cylinder head, and at least two coolant jackets fluidically communicating with a passage therebetween at a merged exhaust line, the passage therebetween extending to the exterior side-wall and serving to supply the cylinder head with coolant via a cylinder block.

19. The system of claim 18, wherein gases from the first and second merged exhaust lines converge at an end of the inner separating wall which is positioned outside of the cylinder head at a distance from the exterior side-wall of the cylinder head.

20. The system of claim 19, wherein the distance is a predetermined distance which is based on a desired torque characteristic in the engine.

* * * * *